US007365255B1

(12) United States Patent
Piskulic et al.

(10) Patent No.: US 7,365,255 B1
(45) Date of Patent: Apr. 29, 2008

(54) OPTIMALLY COUPLED STRING INSTRUMENT BRIDGE

(75) Inventors: John J. Piskulic, 4511 Greyfield, St. Louis, MO (US) 63128; Thomas E. Kieffer, St. Louis, MO (US)

(73) Assignee: John J. Piskulic, St. Louis, MO (US)

( * ) Notice: Subject to any disclaimer, the term of this patent is extended or adjusted under 35 U.S.C. 154(b) by 198 days.

(21) Appl. No.: 11/298,356

(22) Filed: Dec. 12, 2005

(51) Int. Cl.
*G10D 3/04* (2006.01)

(52) U.S. Cl. ..... 84/298; 84/299; 84/307

(58) Field of Classification Search ..... 84/298, 84/299, 307
See application file for complete search history.

(56) References Cited

U.S. PATENT DOCUMENTS 572,677 A * 12/1896 Goodwin ..... 84/297 R
3,174,380 A * 3/1965 Cookerly et al. ..... 84/307
4,202,240 A * 5/1980 Smith ..... 84/297 R
4,208,941 A * 6/1980 Wechter ..... 84/298
4,304,163 A * 12/1981 Siminoff ..... 84/314 N
4,768,414 A * 9/1988 Wheelwright ..... 84/298
5,285,710 A 2/1994 Chapman
5,295,427 A * 3/1994 Johnsen ..... 84/307
5,477,764 A * 12/1995 Carrico ..... 84/297 R
6,133,515 A * 10/2000 Hoshino ..... 84/307
6,870,083 B2 * 3/2005 Turner ..... 84/298
6,919,501 B2 * 7/2005 Burton ..... 84/313
7,098,391 B2 * 8/2006 Wilson ..... 84/453
7,112,733 B1 * 9/2006 Babicz ..... 84/298
2003/0172793 A1 * 9/2003 Hori ..... 84/298

* cited by examiner

*Primary Examiner*—Lincoln Donovan
*Assistant Examiner*—Robert W Horn
(74) *Attorney, Agent, or Firm*—Kevin L. Klug

(57) ABSTRACT

An optimally coupled stringed musical instrument bridge having an individual bridge assembly supporting and retaining each string. Each assembly comprises an action (height) and intonation (length) adjustable string support assembly and string retention assembly integrally incorporated into the instrument body. The bridge minimizes acoustic energy lost to friction, thereby increasing sustain, minimizes fundamental or harmonic interaction between strings, and maximizes acoustic energy transmitted to the instrument body, thereby allowing the natural instrument resonances to emanate. The bridge and its attributes are especially suited for use with bass guitars.

18 Claims, 8 Drawing Sheets

OPTIMALLY COUPLED STRING INSTRUMENT BRIDGE

BACKGROUND OF THE INVENTION

The art of the present invention relates to musical instrument bridges in general and more particularly to a musical instrument bridge which efficiently transmits string energy into an instrument body yet maximally isolates individual string energy from other strings on the instrument.

Conventional stringed musical instruments such as guitars have one or more strings affixed or mounted along the length of the instrument. Said strings typically pass over a nut distal the musician and are fixed and tensioned by a tensioning adjustment, tuner, or tuning pegs at a first end. At a second end, said strings pass over a bridge and are anchored to a bridge plate or the instrument body itself. The vibrating length of the string is between said nut and bridge with said bridge typically having parallel adjustment with the string axis in order to shorten or lengthen said vibrating length. Vibrating length adjustment is necessary in order to achieve perfect intonation. That is for the western tonal system, an octave (i.e. twice the fundamental vibrating frequency) represents 12 half steps or logarithmic chromatic frequency divisions between notes of equivalent type. (e.g. A to A, C to C, etc.) Especially for fretted instruments such as a guitar, depression of a string located at the $12^{th}$ fret position away from the nut must produce a perfect octave relative to an open string. This intonation adjustment is only achievable if the vibrating length is adjustable since intonation is dependent on string mass and elastic properties.

For playability ease and optimization, it is desirable to minimize the musician imposed force between a string and the fretboard or neck in order to create a desired note. This is typically known as an easy "action" and means that the musician minimizes his or her effort during play. Unfortunately, too easy of an action, i.e. a string positioned very close to the fretboard or neck, creates a "buzz" or nonlinear resonance. Conventional stringed musical instruments thereby require adjustment of the string height relative to the neck or fretboard. Since said nut is usually affixed to the instrument, optimal string height is typically achieved by adjusting the bridge height.

Prior art bridges often provide bridge height adjustment via one or more semi-pointed setscrews threaded substantially perpendicularly through a saddle and seating or bearing upon a metal base plate attached with the instrument body. This prior art configuration transmits string vibration into the instrument body via the tip of said setscrews. Unfortunately, the acoustic impedance mismatch between said setscrew point and said plate and the frictional movement between the aforesaid fails to achieve high quality string tone and sustain. That is, without a solid connection between a string and the instrument body, the string energy attenuates rapidly and does not readily transmit into the body. The resulting poor tonal quality and sustain is especially noticeable for low frequency notes such as found in bass guitars. This is especially true for a bass guitar which often relies upon body and neck resonance for high quality note representation.

The aforesaid prior art bridge systems utilize said base plate mounted via screws to the body of the instrument without an integral attachment there between. Upon this base plate are mounted said bridge saddles that are aligned with and support each string. Unfortunately, the prior art often retains the string via this plate whereby string force tends to pull said plate away from the instrument body. This force further limits the energy transmitted to the instrument body, especially when a minute gap forms there between. That is, the string force prevents a solid connection between the string and instrument body. Variations of the prior art mounting methods are shown and described in U.S. Pat. No. 4,208,941 entitled Adjustable Bridge Saddle by Wechter with issue date of Jun. 24, 1980, U.S. Pat. No. 5,285,710 entitled Adjustable Bridge for a Stringed Musical Instrument by Chapman with issue date of Feb. 15, 1994, and U.S. Pat. No. 5,295,427 entitled Bridge for String Instruments by Johnsen with issue date of Mar. 22, 1994.

Said prior art bridge systems also generate undesirable fundamental or harmonic interaction between the strings on a multi string instrument. Since the bridge comprises a continuous metallic base plate of different acoustic impedance than the wood, polymer, or composite material of the body, acoustic energy is reflected from the interface and retained within said bridge. Since the metallic base plate structure is not highly attenuating, said energy is transmitted to other strings retained by said base plate and induces unwanted vibration thereon.

The present art overcomes the prior art limitations with a uniquely constructed and body attached bridge apparatus which minimizes string energy loss and maximizes acoustic energy transmission into the instrument body. Unlike the prior art, each bridge piece of the present art is a solid construction which is secured to the instrument body and thereby maximizes tonal purity and sustain and minimizes harmonic interaction between the strings.

The present art not only provides the aforesaid benefits via a string support assembly but further utilizes a unique string retention assembly whereby acoustic separation and body transmission is assured. That is, the string retention assembly of the present art is integral with and internal to the instrument body. This arrangement provides an acoustic energy feed directly into the body of the instrument for any energy transmitted past the string support assembly via the strings.

Accordingly, an object of the present invention is to provide an optimally coupled string instrument bridge and method of manufacture which maximizes acoustic energy transmission into the body of the instrument.

Another object of the invention is to provide an optimally coupled string instrument bridge and method of manufacture which maximally isolates fundamental and harmonic vibratory interaction between strings on the instrument.

A further object of the present invention is to provide an optimally coupled string instrument bridge and method of manufacture having strings secured to the instrument body and not the bridge whereby said bridge is not forcibly pulled away from said body.

A still further object of the invention is to provide an optimally coupled string instrument bridge and method of manufacture which provides all of the length and height adjustment features of a conventional bridge without the undesirable coupling and transmission characteristics.

A yet further object of the invention is to provide an optimally coupled string instrument bridge and method of manufacture which minimizes the acoustic impedance mismatch between the bridge assembly and the instrument body.

SUMMARY OF THE INVENTION

To accomplish the foregoing and other objects of this invention there is provided an optimally coupled string instrument bridge and method of manufacture for obtaining maximum energy transmission, sustain, and tonal quality without string harmonic interaction. The apparatus and method is useful with stringed instruments and more particularly with guitars, especially bass guitars.

The apparatus is provided as a bridge comprised of individual assemblies for each string of the instrument. Each individual assembly comprises a string support assembly and a string retention assembly. For a preferred embodiment, each string support assembly comprises an internally threaded base sleeve mounted into the instrument body, a bridge piece capable of adjustable retention within said threaded base sleeve, and a saddle piece within said bridge piece onto which a string is accepted within a groove. Within the preferred embodiment, each string retention assembly comprises an upper guide tube, a retention ferrule into which a string ball end or eyelet seats, and a lower guide tube, all of which are mounted within the instrument body rearward of the support assembly.

Each string support assembly anchors and mates intimately with the instrument body via the base sleeve at an optimal intonation site. Each base sleeve has a substantial cylindrical surface area contacting with and preferably bonded within said body. This large contact area assures maximum transmission of acoustic energy into the instrument body. Each string retention assembly is also bonded or pressed into said body whereby a string is held by the body and not the support assembly. The combination of the aforesaid efficiently transmits vibratory energy into the body of the instrument while also isolating vibrations or energy coupling between adjacent strings.

The threaded mate between the bridge piece and base sleeve further provides the desired string height adjustment via rotation of said bridge piece. Movement of the saddle piece within a channel within the bridge piece further allows intonation adjustment. The aforesaid adjustments are typically performed without tension on the supported string. That is, the strings are removed or partially removed.

The art of the present invention may be manufactured from a plurality of materials including but not limited to brass or copper materials, steels, titanium, aluminum, (and alloys thereof), composites, polymers, woods, or ceramics. In the preferred embodiment, said bridge assemblies are each manufactured from brass.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
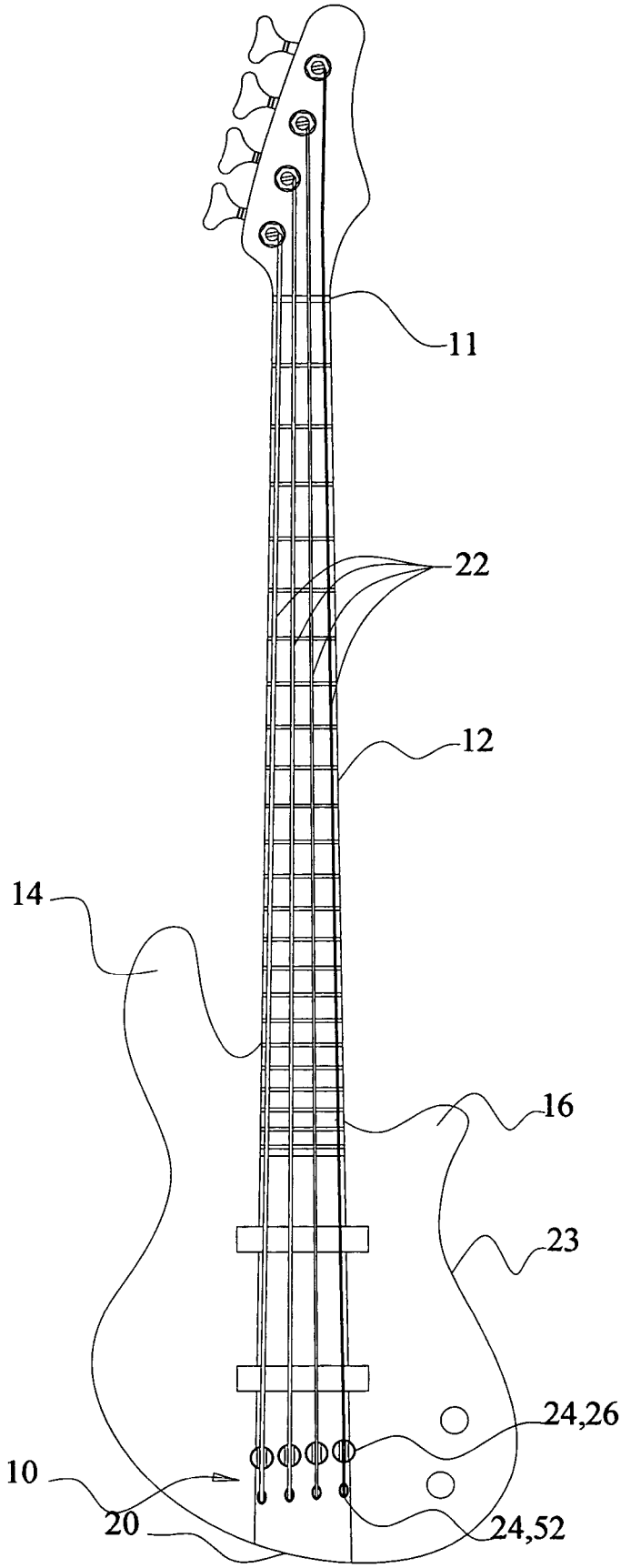
FIG. 1 is a front plan view of an optimally coupled string instrument bridge mounted with a bass guitar and showing the complete guitar for clarity of placement.
Figure 2:
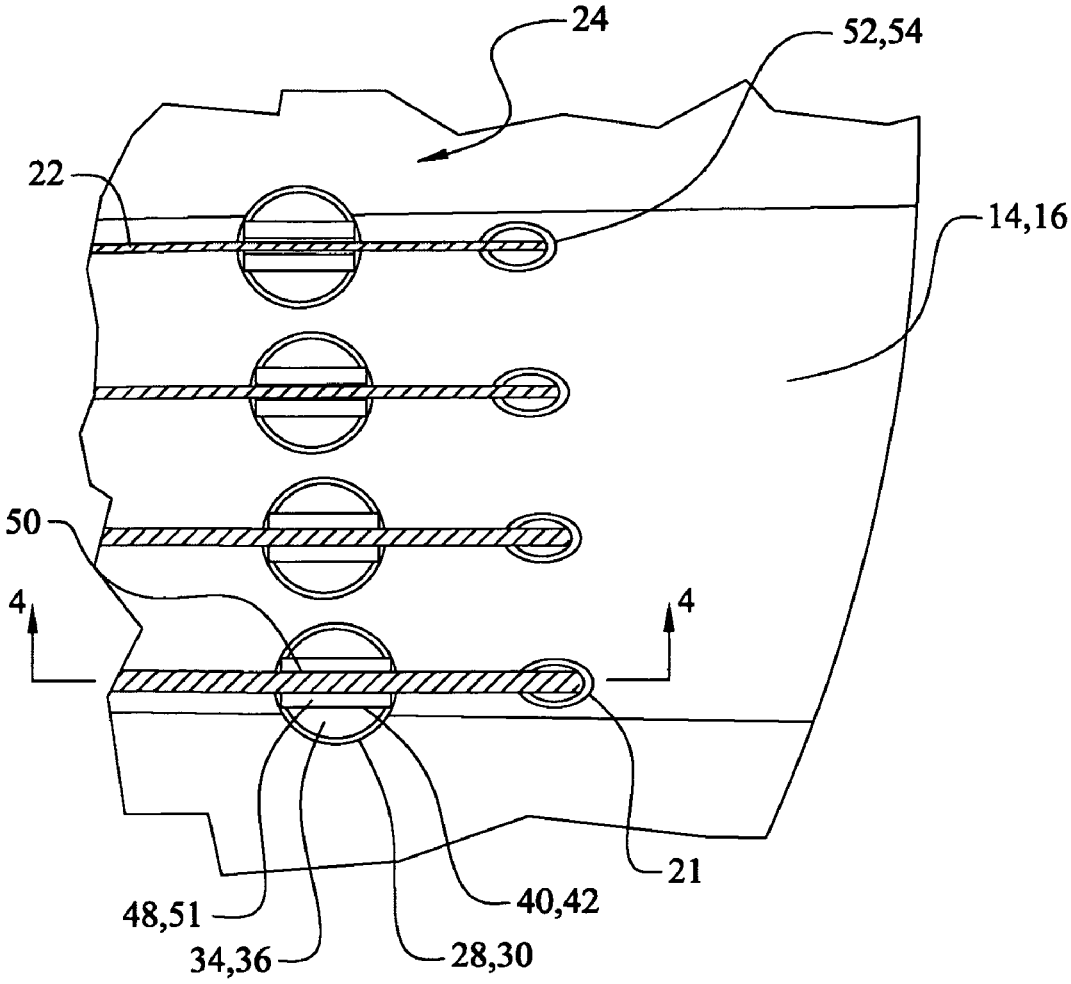
FIG. 2 is an exploded front face plan view of an optimally coupled string instrument bridge also mounted with a bass guitar.
Figure 3:
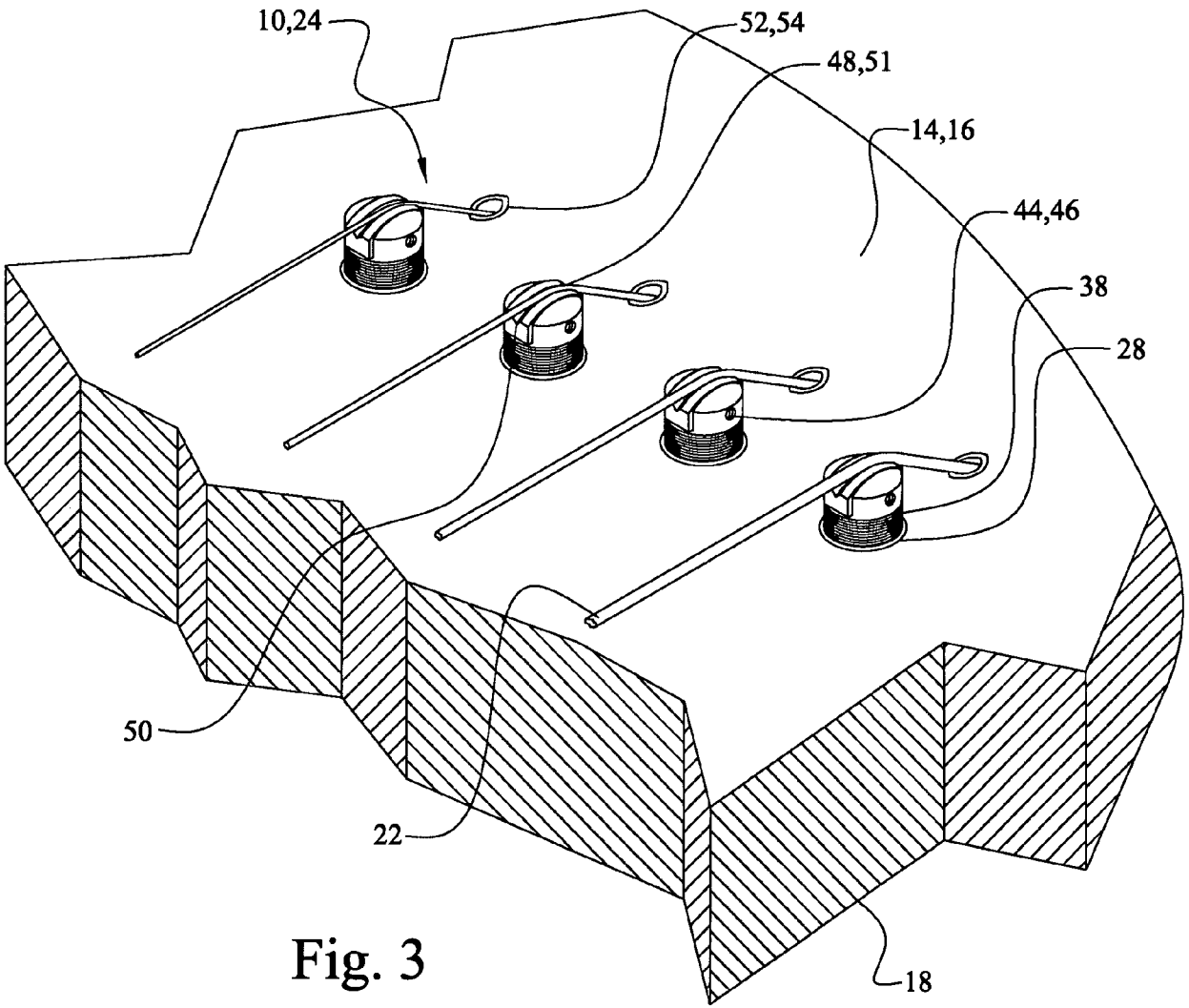
FIG. 3 is a perspective view of a preferred optimally coupled string instrument bridge mounted with a body portion of a four string bass guitar.
Figure 4:
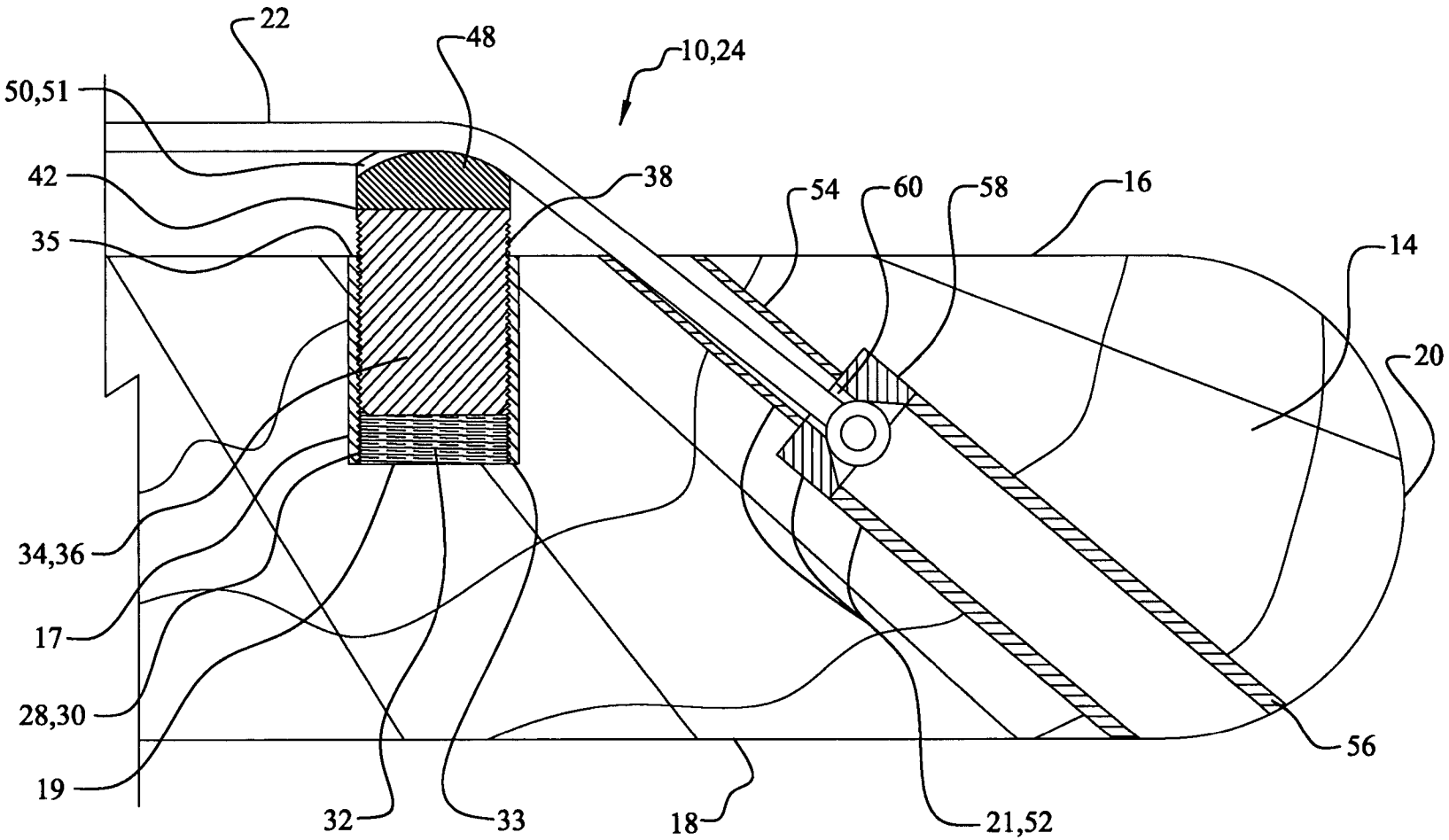
FIG. 4 is a cross section view taken along line 4-4 of FIG. 2.
Figure 5:
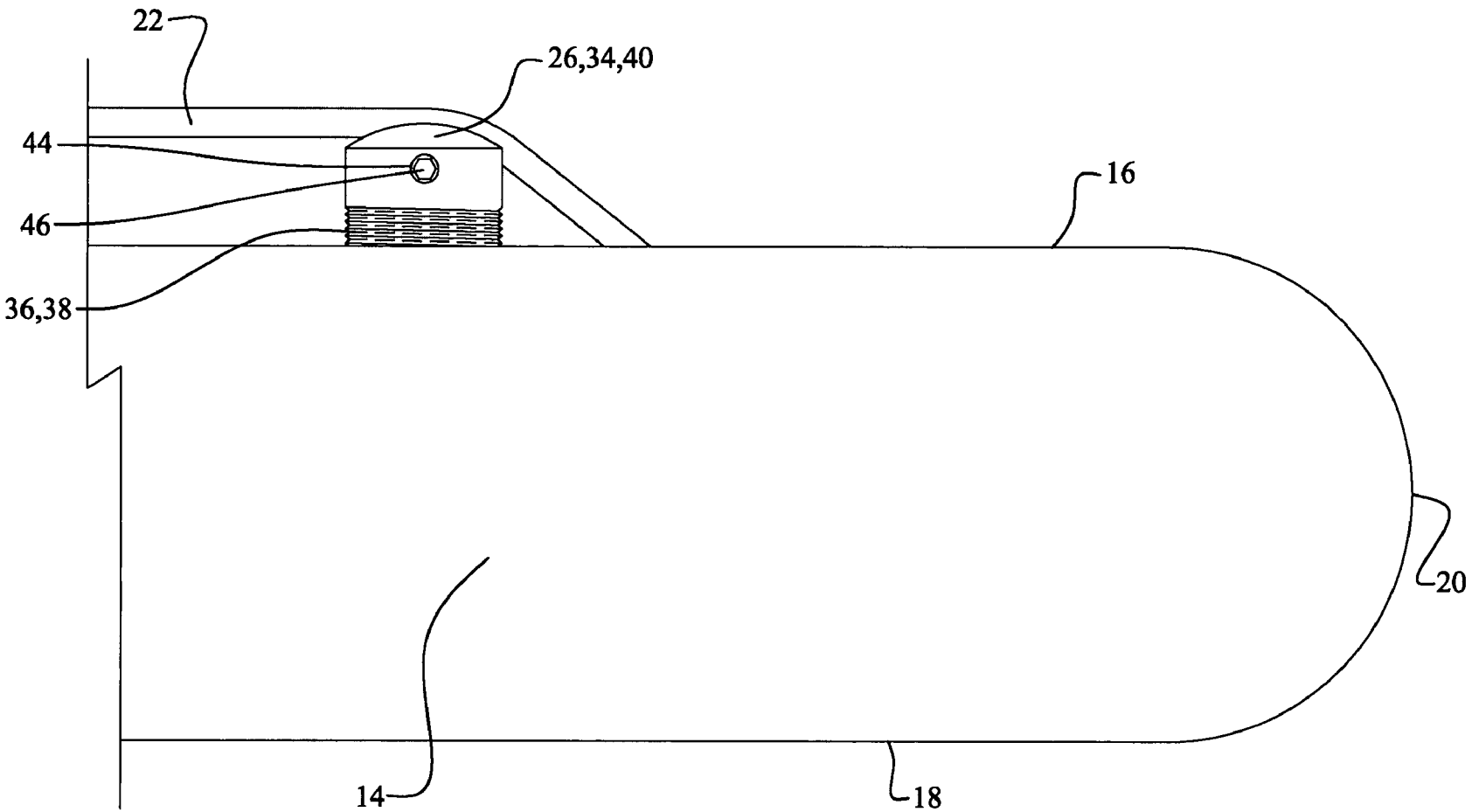
FIG. 5 is a top plan view of an optimally coupled string instrument bridge mounted with a stringed instrument.
Figure 6:
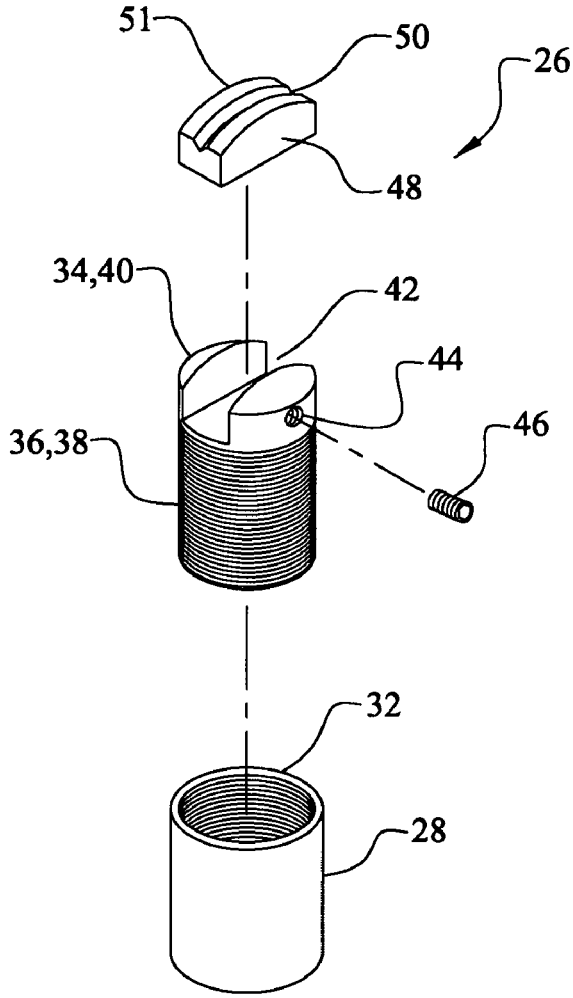
FIG. 6 is an assembly view of a string support assembly.
Figure 7:
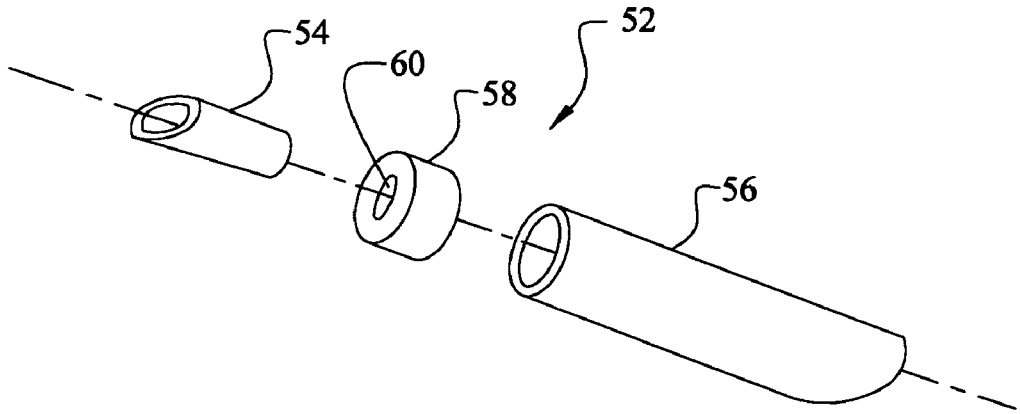
FIG. 7 is an assembly view of a string retention assembly.
Figure 8:
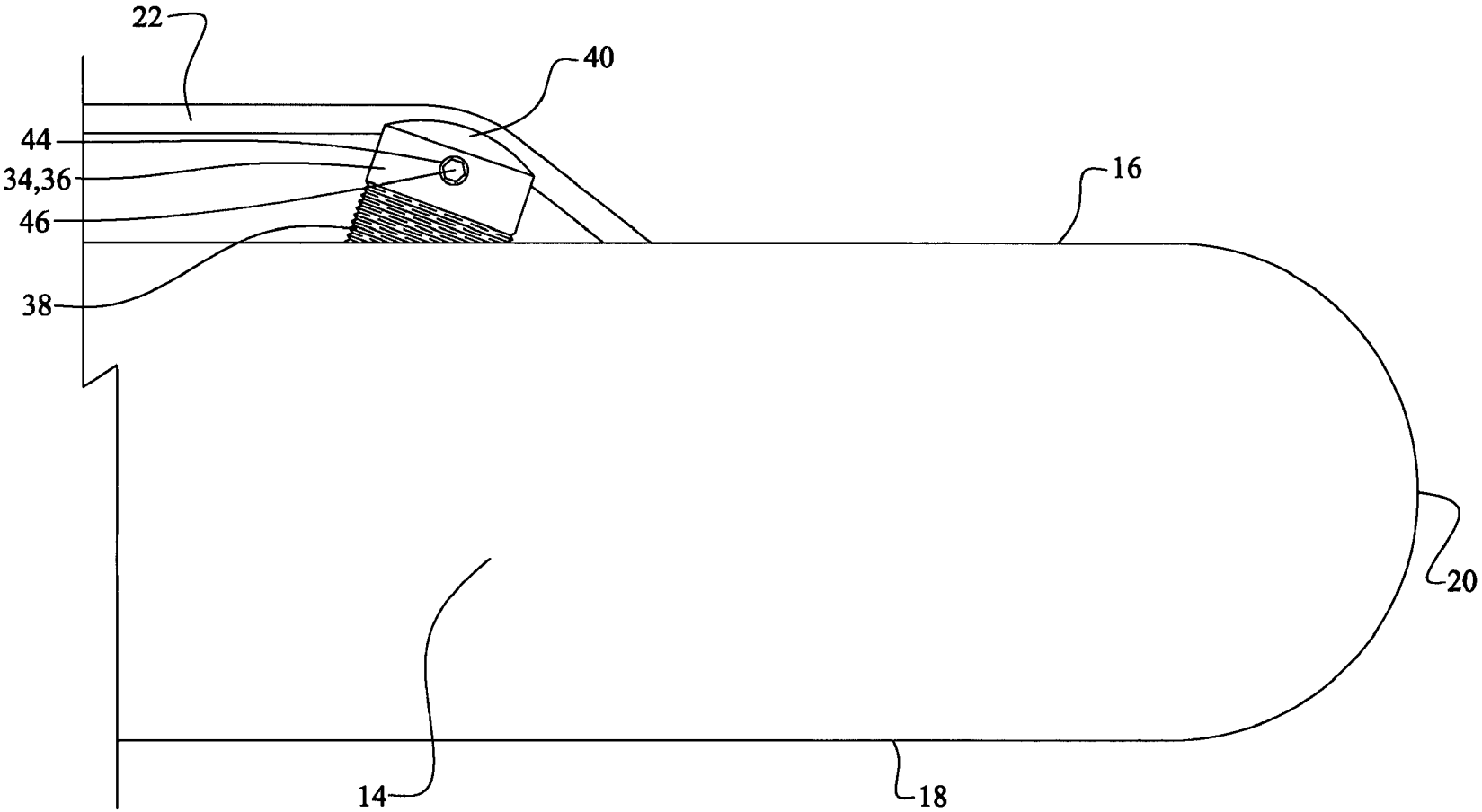
FIG. 8 is a top plan view of an alternative embodiment showing the string support assembly canted rearward or towards the body rear portion.
Figure 9:
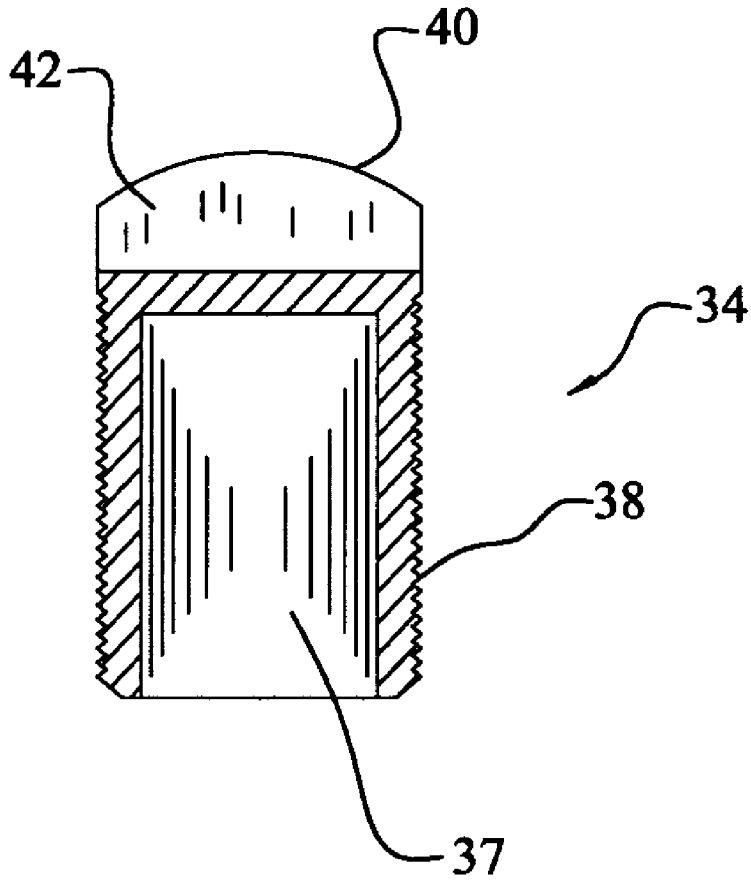
FIG. 9 is a cross section view of an alternative embodiment bridge piece taken along the same line as the cross sectional bridge piece of FIG. 4.

Referring now to the drawings, there is shown in FIGS. 1-7 a preferred embodiment and in FIGS. 8 & 9 an alternative embodiment of an optimally coupled string instrument bridge 10. The bridge 10 provides height and intonation adjustments and also provides better coupling of the string 22 vibration into the instrument body 14. The apparatus further provides superior acoustic isolation between the strings 22 on the instrument.

A stringed musical instrument incorporating the present art comprises a body 14 having a body face 16, a body back 18, and a body rear portion 20, a neck 12, and one or more strings 22 supported by a bridge assembly 24 and a nut 11 opposite said bridge 24. The strings 22 are retained via the tension imparted thereto between a retention assembly 52 mounted with said body 14 and a tensioning adjustment or tuning peg apparatus opposite said retention assembly 52.

For the preferred embodiment, each string 22 is supported and retained by an individual bridge assembly 24 comprising a string support assembly 26 and a string retention assembly 52. The string support assembly 24 first comprises a base sleeve 28 mounted within the body 14 through the body face 16 and within a body face hole 17. That is, in a preferred embodiment, the base sleeve 28 is a cylindrical tube 30 which is recessed and held into the instrument body 14 through the body face 16 and sized to fit said face hole 17. In a preferred embodiment said sleeve 28 is pressed and adhesively epoxy bonded into said body 14. Alternative embodiments may utilize only a frictional fit, other adhesives than epoxy, other cross sectional sleeve 28 shapes, or forgo use of said sleeve 28 as a separated element and form said sleeve 28 as an integral portion of said body 14.

In a preferred embodiment, the base sleeve 28 is a cylindrical tube 30 having internal threads 32 and a flat bottom side 33 which contacts the base 19 of the body face hole 17. Also in a preferred embodiment, when recessed into the instrument body 14, a top side 35 is finished substantially flush with the body face 16, whether said face 16 is curved or flat. The central axis of the base sleeve 28 is mounted substantially perpendicular to the axis of the string 22 in a preferred embodiment or angled whereby the top side 35 is closer to the body rear portion 20 relative to the bottom side 33, in an alternative embodiment. The alternative mounting method places substantially more of the vectorial string 22 force onto the central axis of the base sleeve 28 and also aids in intonation compensation during string 22 height adjustment.

The string support assembly 24 next comprises a bridge piece 34 which is a substantially solid cylinder 36 in a preferred embodiment. Said cylinder 36 has external threads 38 which are capable of mating with said internal threads 32 of the base sleeve 28. That is, the bridge piece 34 may be adjustably accepted by said base sleeve 28. The bridge piece 34 further has a channel 42 on a top surface 40 of preferably rectangular cross section which is capable of accepting a saddle piece 48. Also in the preferred embodiment, a threaded hole 44 within said piece 34 is substantially perpendicular to and intersecting the run of said channel 42. Said threaded hole 44 is located to accept a setscrew 46 externally and allow said setscrew 46 to forcibly lock or retain said saddle piece into position. In a preferred embodiment, said setscrew 46 is externally adjustable with the instrument fully assembled. Alternative embodiments may forego use of said channel 42 and incorporate the features of said saddle piece 48 into said bridge piece 34 as an integral saddle piece 48 or utilize channels 42 of various geometric cross sections or utilize said channel 42 for string 22 support. Alternative embodiments may also utilize other methods for adjustment of said bridge piece 34 within said base sleeve 28 including but not limited to steps, notches, pins, screws, or frictional mating.

Further alternative embodiments of said bridge piece 34 minimize the acoustic impedance mismatch between the string support assembly 26 and the body 14 whereby maximum acoustic energy is transmitted into the body 14. That is, the acoustic impedance of a material is proportional to the material density (ρ) multiplied by the acoustic velocity (c) or the square root of the density (ρ) divided by the modulus of elasticity (λ, Young's modulus) within the material.

$$Z_O \propto \rho \cdot c \propto \sqrt{\frac{\rho}{\lambda}}$$

Since the bridge piece 34 is typically of a metallic material such as brass and the body is of a wood, composite, or polymer material, the density, elasticity, and velocity differences within the relative materials create an acoustic mismatch. The acoustic mismatch between the body 14 and string support assembly 26 may be more closely matched and thereby maximize acoustic energy transmission if the aforesaid solid cylinder 36 has a recess or hollow portion 37 which reduces volumetric density. The recess or hollow portion 37 is of a volume determined by a diameter and depth which produces the most desirable amount of energy coupling for the musician. Thus, a musician may have varied and multiple volume bridge pieces 34 on a single instrument in order to minimize or maximize the acoustic energy coupled with the body 14 for each string 22.

Said saddle piece 48 is of preferably block form and designed to fit into the channel 42 of said bridge piece 34. The preferred embodiment has a groove 50 in a top end 51 into which the string 22 is accepted and is supported. Preferably said groove 50 is of arcuate form whereby string 22 contact is minimized to a small portion of said groove 50. If the string 22 contact with said saddle 48 is limited to a specific contact point, the vibrating string 22 length variation during play is minimized and tonal quality is maximized.

The string retention assembly 52 is preferably placed and held within a stepped body retention hole 21 within said body 14. The assembly 52 first comprises an upper guide tube 54 which is mounted within said body 14 substantially flush with said body face 16. A retention ferrule 58 having a retention hole 60 larger than said string 22 is positioned within said body 14 between said upper guide tube 54 and a lower guide tube 56. Preferably said lower guide tube 56 is substantially flush with said body back 18. That is, the string retention assembly 52 is substantially surrounded by said body 14 within said stepped body retention hole 21 except at the face 16 and back 18. The lower guide tube 56 inside diameter is of greater diameter and the upper guide tube 54 inside diameter and retention hole 60 is of smaller diameter than a string 22 ball end or eyelet. Alternative embodiments may utilize a string retention assembly 52 having fewer or greater component parts or forgo use of said assembly 52 as a separated element and form said assembly 52 as an integral portion of said body 14.

Assembly and manufacture of the present art instrument bridge 10 begins with forming or placement of the stepped body retention holes 21. This is typically performed by drilling a smaller angled hole toward the body rear portion 20 from the body face 16 for upper guide tube 54 retention and counter-drilling said smaller hole to form a larger hole from the body back 18 for lower guide tube 56 retention. Preferably said holes are sized to intimately fit an outer diameter of said guide tubes 54,56. Said upper guide tube 54 is then pressed and preferably adhesively bonded (i.e. epoxy) in place from said face 16, said retention ferrule 58 is pressed and bonded from said back 18 and thereafter the lower guide tube 56 is also pressed and bonded in place. In the preferred embodiment, said tubes 54, 56 are finished substantially flush with said body face 16 and back 18 respectively.

In the preferred embodiment, each stepped body retention hole 21 is positioned on said body 14 in order to maintain a relatively and substantially constant distance from the respective individual string support assembly 26 for all of said assemblies 26. That is, lighter gauge strings typically require said string support assembly 26 positioning slightly closer to said nut 11 in order to optimize intonation. The stepped body retention holes 21 are thereby positioned closer to said nut 11 in order to maintain said constant distance. On many stringed instruments, especially guitars, support assembly 26 and retention assembly 52 placement moves toward the nut 11 distally from the musician since the string gauge is lightest near the body bottom 23.

The body face holes 17 are then placed in said body face 16, said base sleeves 28 are pressed into said holes 17 with the bottom side 33 seated onto the base 19, and each sleeve 28 is adhesively secured (i.e. epoxy) therein. Said placement is chosen to optimize said intonation placement conditions. Bridge pieces 34 are thereafter threaded within said sleeves 28 to the desired depth for optimum action. The saddle piece 48 is placed within said channel 42 and preferably secured with said setscrew 46.

String 22 placement then proceeds with threading each string 22 through the respective lower guide tube 56, retention ferrule 58 retention hole 60, and the upper guide tube 54. As stated, the ball or eyelet end of the string 22 is larger than the upper guide tube 54 and retention hole 60 inside diameter and thereby seats with said retention ferrule 58. Each string 22 is then stretched across the respective saddle piece 48 within said top end 51 groove 50 towards the nut 11, seated with said nut 11 and retained and tuned by the tuning assembly, tuning pegs, or tuners. Upon assembly, intonation is optimized via adjustment of the saddle pieces 48 toward or away from said nut 11.

Those skilled in the art will appreciate that an optimally coupled string instrument bridge 10 apparatus and method of manufacture and use has been shown and described. Said present art utilizes a bridge assembly 24 with a large contact area between the support assembly 26 and instrument and also utilizes a retention assembly 52 incorporating the instrument body 14 for string retention whereby string forces and energy are concentrated onto and into the instrument body 14. The present art provides optimum coupling into the instrument body 14 resulting in better tonal quality due to resonances within the instrument whereby different frequencies of the audio spectrum are diminished or reinforced. The integral body 14 mounting further provides an improved sustain characteristic, i.e. the decay time of a plucked string is longer.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. An optimally coupled string instrument bridge comprising:

one or more individual bridge assemblies each comprising a string support assembly and a string retention assembly; and said string support assembly further comprising a base sleeve having a top side and a bottom side and sized to mount within a face hole within a stringed instrument body and a bridge piece having a top surface and sized to adjustably be accepted by said base sleeve whereby an action may be adjusted; and said bridge piece having a top surface saddle piece capable of supporting a first string and said saddle piece having a groove within which said string is accepted on a top end of said saddle piece; and said bridge piece having a channel on said top surface capable of movably receiving said saddle piece toward or away from a nut whereby an intonation may be adjusted separate from said action; and said string retention assembly sized to mount with said instrument body rear of said string support assembly and retain a string ball or eyelet within said instrument body and in combination with said string support assembly efficiently transmit a vibratory energy into said instrument body while also isolating a coupling of said vibratory energy between said first string and one or more second strings.

2. The optimally coupled string instrument bridge as described in claim 1 whereby:

said base sleeve comprises substantially a tube; and said bridge piece is sized to moveably fit within said tube.

3. The optimally coupled string instrument bridge as described in claim 2 whereby:

said base sleeve has internal threads; and said bridge piece has external threads which are capable of mating with said internal threads.

4. The optimally coupled string instrument bridge as described in claim 3 whereby:

said bridge piece having a recess or a hollow portion which reduces a volumetric density and maximizes said energy transmission into said instrument body.

5. The optimally coupled string instrument bridge as described in claim 1 whereby:

said bridge piece a channel is of a substantially rectangular cross section on said top surface capable of movably receiving said saddle piece toward or away from said nut whereby said intonation may be adjusted.

6. The optimally coupled string instrument bridge as described in claim 5 further comprising:

a setscrew within a threaded hole within said bridge piece and positioned substantially perpendicular to and intersecting a run of said channel whereby said setscrew is capable of retaining said saddle piece.

7. The optimally coupled string instrument bridge as described in claim 6 further comprising:

a groove on a top end of said saddle piece into which said string is accepted and supported towards said nut, said groove having an arcuate form whereby a contact of said string is minimized to a small portion of said groove.

8. The optimally coupled string instrument bridge as described in claim whereby:

said string retention assembly further comprises one or more guide tubes sized to mount and hold within a stepped body retention hole within said instrument body rear of said string support assembly.

9. The optimally coupled string instrument bridge as described in claim 8 whereby:

said one or more guide tubes further comprise an upper guide tube having an inside diameter smaller than said string ball or eyelet; and a lower guide tube having an inside diameter greater than said string ball or eyelet; and a retention ferrule having a retention hole smaller than said string ball or eyelet and positioned within said stringed instrument body between said upper guide tube and said lower guide tube; and said upper guide tube, lower guide tube, and retention ferrule sized to fit within said instrument body.

10. The optimally coupled string instrument bridge as described in claim 4 whereby:

said bridge piece channel is of a substantially rectangular cross section on said top surface capable of movably receiving said saddle piece toward or away from said nut whereby said intonation may be adjusted.

11. The optimally coupled string instrument bridge as described in claim 4 whereby:

said string retention assembly further comprises one or more guide tubes sized to mount and hold within a stepped body retention hole within said instrument body rear of said string support assembly.

12. The optimally coupled string instrument bridge as described in claim 11 whereby:

said one or more guide tubes further comprise an upper guide tube having an inside diameter smaller than said string ball or eyelet; and a lower guide tube having an inside diameter greater than said string ball or eyelet; and a retention ferrule having a retention hole smaller than said string ball or eyelet and positioned within said stringed instrument body between said upper guide tube and said lower guide tube; and said upper guide tube, lower guide tube, and retention ferrule sized to fit within said instrument body.

13. The optimally coupled string instrument bridge as described in claim 12 whereby:

said bridge piece channel is of a substantially rectangular cross section on said top surface capable of movably receiving said saddle piece toward or away from said nut whereby said intonation may be adjusted.

14. An optimally coupled string instrument bridge in combination with a stringed musical instrument comprising:

a neck having a nut and one or more tuners; and a body having a body face, body back, body rear portion, body bottom, and one or more body face holes within said body face; and one or more strings; and one or more individual bridge assemblies each comprising a string support assembly and a string retention assembly; and said string support assembly further comprising a bridge piece having a top surface and sized to adjustably be accepted with said face holes whereby an action may be adjusted; and said bridge piece having a top surface saddle piece capable of supporting said string; and said string retention assembly sized to mount with said instrument body toward said rear portion relative to said string support assembly and retain a string ball or eyelet; and a base sleeve having a top side and a bottom side and sized to mount within said face hole and adjustably accept said bridge piece whereby said bridge piece is adjustably accepted with said face holes; and said saddle piece has a top end groove and is moveable within a channel within said top surface of said bridge piece whereby an intonation may be adjusted; and said base sleeve comprises a substantially cylindrical tube having internal threads; and said bridge piece comprises substantially a cylinder having external threads at least partially mating with said internal threads.

15. An optimally coupled string instrument bridge in combination with a stringed musical instrument as described in claim 14 whereby said string retention assembly further comprises:

one or more body retention holes within said body and from said body back to said body face and through which said strings are threaded and said string ball or eyelet are retained.

16. An optimally coupled string instrument bridge in combination with a stringed musical instrument as described in claim 15 whereby said string retention assembly further comprises:

an upper guide tube having an inside diameter smaller than said string ball or eyelet and through which said string threads; and a lower guide tube having an inside diameter greater than said string ball or eyelet and through which said string ball or eyelet passes; and a retention ferrule having a retention hole smaller than said string ball or eyelet onto which said string ball or eyelet seats.

17. A method of optimally coupling a bridge with a stringed musical instrument, the steps comprising:

forming a stringed musical instrument having one or more strings, a neck with a nut and a tuner, a body with a body face, a body back, a body rear portion, and a body bottom; and forming one or more body face holes in said body face; and inserting a base sleeve within said body face holes; and threading said base sleeve with internal threads; and threading a bridge piece with external threads which may be mated with said internal threads; and creating a channel on a top surface of said bridge piece; and mating some or all of said external threads with said internal threads; and inserting a saddle piece having a groove on a top end within said bridge piece channel; and securing said saddle piece within said channel; and forming a body retention hole through said body; and threading a string through said body retention hole over said saddle piece within said groove and over said nut; and fixing and tensioning said strings with said tuner.

18. The method of optimally coupling a bridge with a stringed musical instrument as set forth in claim 17, the steps further comprising:

forming said body retention hole from said body back to said body face; and inserting an upper guide tube having an inside diameter smaller than said string ball or eyelet but larger than said string into said retention hole nearest said body face; and inserting a retention ferrule having a retention hole smaller than said string ball or eyelet but larger than said string between said body back and said body face; and inserting a lower guide tube having an inside diameter greater than said string ball or eyelet into said retention hole nearest said body back; and inserting said string through said lower guide tube, retention hole, and upper guide tube; and seating said ball or eyelet with said retention ferrule.

* * * * *